United States Patent [19]

Ogawa et al.

[11] Patent Number: 4,843,837

[45] Date of Patent: Jul. 4, 1989

[54] HEAT PUMP SYSTEM

[75] Inventors: Yasuo Ogawa; Nobuharu Noji, both of Kanagawa; Keiji Koike, Tokyo, all of Japan

[73] Assignee: Technology Research Association of Super Heat Pump Energy Accumulation System, Japan

[21] Appl. No.: 103,523

[22] Filed: Sep. 29, 1987

[30] Foreign Application Priority Data

Feb. 25, 1986 [JP] Japan ..... 61-43920
Oct. 1, 1986 [JP] Japan ..... 61-231220
Dec. 18, 1986 [JP] Japan ..... 61-300084

[51] Int. Cl.[4] ..... F25B 13/00

[52] U.S. Cl. ..... 62/324.1; 62/471; 62/503; 62/512

[58] Field of Search ..... 62/114, 504, 509, 513, 62/503, 512, 527, 528, DIG. 21, 87, 117, 509, 471

[56] References Cited

U.S. PATENT DOCUMENTS

| | | | |
|---|---|---|---|
| 2,277,647 | 3/1942 | Jones | 62/DIG. 21 |
| 2,975,613 | 3/1961 | Heidorn | 62/471 X |
| 3,071,935 | 1/1963 | Kapeker | 62/503 X |
| 3,095,710 | 7/1963 | Clark | 62/117 |
| 3,309,897 | 3/1967 | Russell | 62/512 |
| 3,310,103 | 3/1967 | Osborne | 62/512 X |
| 3,680,326 | 8/1972 | Huelle | 62/503 X |
| 4,194,367 | 3/1980 | Lavik | 62/503 X |
| 4,213,308 | 7/1980 | Anderson | 62/503 X |
| 4,303,536 | 12/1981 | Orfeo et al. | 62/114 X |
| 4,341,086 | 7/1982 | Ishii | 62/512 |
| 4,498,999 | 2/1985 | Ramet et al. | 62/114 X |
| 4,517,811 | 5/1985 | Atsumi et al. | 62/509 X |
| 4,551,983 | 11/1985 | Atsumi et al. | 62/509 X |
| 4,680,939 | 7/1987 | Rojey et al. | 62/114 |
| 4,707,996 | 11/1987 | Vobach | 62/114 |

FOREIGN PATENT DOCUMENTS

| | | |
|---|---|---|
| 60-36845 | 2/1985 | Japan . |
| 60-36853 | 2/1985 | Japan . |
| 60-36854 | 2/1985 | Japan . |
| 60-108667 | 6/1985 | Japan . |
| 60-152868 | 8/1985 | Japan . |
| 60-166371 | 8/1985 | Japan . |
| 60-166372 | 8/1985 | Japan . |
| 60-166373 | 8/1985 | Japan . |
| 60-166374 | 8/1985 | Japan . |
| 60-226668 | 11/1985 | Japan . |
| 60-238650 | 11/1985 | Japan . |
| 61-159053 | 7/1986 | Japan . |
| 61-179286 | 8/1986 | Japan . |
| 61-262550 | 11/1986 | Japan . |

*Primary Examiner*—Lloyd L. King
*Attorney, Agent, or Firm*—Wenderoth, Lind & Ponack

[57] ABSTRACT

A heat pump system adapted to use a non-azeotropic refrigerant mixture preferably containing a high boiling temperature refrigerant as a primary component thereof is given an improved heat transfer efficiency and its pressure loss is minimized by arranging a refrigerant extracting means for removing the refrigerant stagnating in the system in an unfavorable state, in a vapor state in a condenser or in liquid state in an evaporator and returning the removed refrigerant into a refrigerant circulating passage of the system; and by constructing an evaporator of a flooded type at least at a portion adjacent to a refrigerant outlet portion of the evaporator.

20 Claims, 21 Drawing Sheets

Fig. 11
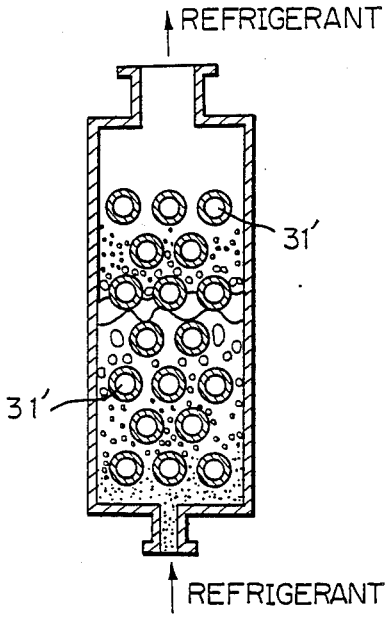
Fig. 12 (REFERENCE)
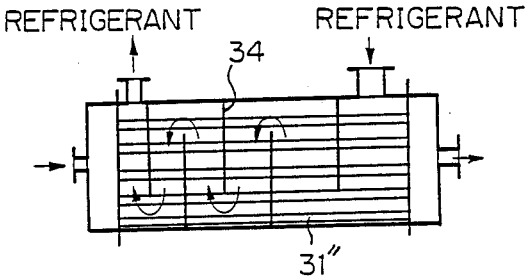
Fig. 13 (REFERENCE)
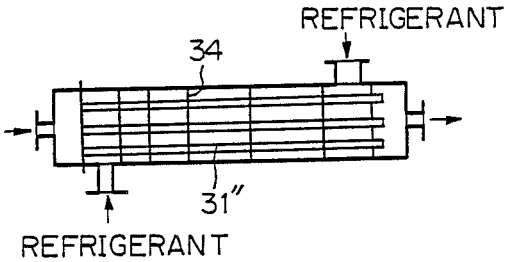

TEMPERATURE
TEMPERATURE
Δt
D 50°C
L t3=t0+Δt=48°C
K t0=47°C
M t2≒47°C
I t1=44.5°C
H
E
45°C
42°C
F
45°C
50°C
HEAT SOURCE FLUID TEMPERATURE
C
C'
B
B'
A
A'
A1
a
a'
b
b'
0.1
0.5
R-113
R-114

HEAT PUMP SYSTEM

FIELD OF INVENTION

The present invention relates to a heat pump system and more particularly to a heat pump system using a non-azeotropic refrigerant mixture for effecting a heat pump cycle.

BACKGROUND OF INVENTION

Recently, utilization of non-azeotropic refrigerant mixtures has been introduced in order to improve the coefficient of performance (COP) of heat pumps. In cases where a non-azeotropic refrigerant mixture is used in a heat pump, a counter-flow type evaporator has usually been employed so as to make the best use of the characteristics of the non-azeotropic mixture. Also, as the non-azeotropic mixture, a mixture containing a relatively larger molar fraction of a low boiling temperature refrigerant than that of a high boiling temperature refrigerant has been used.

However, in certain cases, such as a heat pump system employing, for example, a centrifugal-compressor, it is preferable to use a refrigerant having a certain degree of specific volume and therefore, it has been desired to use a refrigerant mixture containing a high boiling temperature refrigerant as a primary component. However, if a non-azeotropic mixture containing a larger molar fraction of a high boiling temperature refrigerant is used in a heat pump system, a high speed flow of a refrigerant vapor having a large specific volume is induced in the evaporator causing a pressure loss which leads to a power loss.

Also, use of a non-azeotropic refrigerant mixture naturally causes difference in respect of vaporization of the respective components as a result of which a certain component of the refrigerant mixture may stagnate within the system which may reduce the efficiency of the system. More particularly, in an evaporator, a mixture in liquid state containing a relatively high percentage of a high temperature boiling refrigerant is likely to stay at an outlet portion of the evaporator so that heat transfer in the evaporator is impeded compared to the case where a single refrigerant is used. Or, in a condenser, an uncondensed refrigerant mixture which is rich in respect of a low boiling temperature component is likely to stay at a portion adjacent to a refrigerant outlet, thus reducing heat transfer efficiency.

Accordingly, there has been a demand for a heat pump system wherein a non-azeotropic refrigerant is effectively utilized.

SUMMARY OF INVENTION:

It is an object of the present invention to provide a heat pump system which is free from the drawbacks of the prior art.

It is a further object of the present invention to provide a heat pump system which can make the best of the characteristics of a non-azeotropic refrigerant mixture.

The above objects are accomplished according to the present invention.

The term "heat pump" or "heat pump system" used throughout the present specification and claims is meant to identify a system generally comprising a compressor, a condenser, a throttle valve or a pressure reduction means, an evaporator and a refrigerant circulating passage for coupling the above elements to conduct the refrigerant through the system and such heat pump system is to be broadly interpreted to cover a heat pump system effecting a heat pump cycle not only for warming a fluid but also for cooling a fluid.

In order to achieve the objects of the present invention, the following are considered with the premise of using a non-azeotropic refrigerant mixture.

(a) An evaporator is employed which is a flooded type at least at a portion adjacent to an outlet of the refrigerant;

(b) The non-azeotropic refrigerant mixture employed is arranged to comprise at least one primary component and one or more kinds of other sub-component refrigerants having molar fraction smaller than that of the primary component and boiling temperatures lower than that of the primary component;

(c) An extracting fluid passage is introduced for removing any unevaporated non-azeotropic refrigerant mixture from an evaporator and directing it to another part of the heat pump system; and (d) an extracting fluid passage is introduced to extract any uncondensed refrigerant mixture from a condenser and direct it to another part of the heat pump system.

The items (a), (b), (c) and (d) may be employed independently or in combination.

As to the term "a flooded type at least at a portion adjacent to an outlet", this refers to an evaporator structure in which flow directions of a heat source fluid and a heat sink fluid are not counter to each other and an evaporated vapor i able to flow upwards at that portion. The nature of the flooded type evaporator will be further clarified later in connection with the accompanying drawings.

The above and further objects and advantages of the present invention will be made clear when the detailed description of the invention is reviewed referring to the accompanying drawings, the brief explanation of which follows hereunder.

BRIEF EXPLANATION OF DRAWINGS:

FIG. 8 is a lateral section of are evaporator, FIG. 9 is an axial section of another evaporator, and FIG. 10 is shows a lateral section of the evaporator shown in FIG. 9;

FIG. 11 is shows a lateral section of another evaporator;

FIG. 12 is a reference drawing explaining a counter-flow type evaporator in an axial section;

FIG. 13 is another axial section of FIG. 12;

DETAILED DESCRIPTION OF INVENTION:

Before describing and explaining the present invention, it will be beneficial to briefly touch upon the points of the prior art a little further so that the present invention may be well understood.

Figure 1:
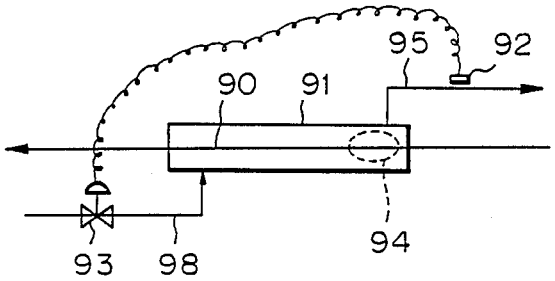
Fig. 1 ( PRIOR ART )
FIG. 1 is a diagram for explaining a controlling system used in a prior art.

In FIG. 1, a conventional system for regulating an over-heat state of refrigerant at an outlet conduit 95 from an evaporator 91 is schematically illustrated. It is assumed that the evaporator is a dry type and a counter-flow type. In the evaporator 91, a refrigerant is introduced through a conduit 98 and the refrigerant effects heat transfer with a heat source fluid passing through a heat transfer conduit 90 so that the refrigerant is converted to vapor and taken out through the outlet conduit 95. In this case, in order to prevent the refrigerant flow from being sucked into a compressor, an over-heat regulation is performed so as to maintain the refrigerant in an over-heated state in the outlet conduit 95. To this end, the temperature of the refrigerant at the outlet conduit 95 is detected by a thermal detector 92 and the information obtained by the detector is sent to a flow regulating valve 93 to control the flow rate in order to keep the refrigerant in the desired super heated state. In this case, it is required to substantially convert the refrigerant at a region 94 within the evaporator 91 adjacent to the outlet thereof in order to completely maintain the super heated state at the outlet conduit 97.

Accordingly, in case of employment of a refrigerant mixture containing, for example, Fluoro Carbon (hereinafter referred to as CFC) 11 or 113 as a primary component, which has a large specific volume, a high speed flow of the refrigerant is induced at the region 94 whereby pressure loss becomes greater.

Figure 2:
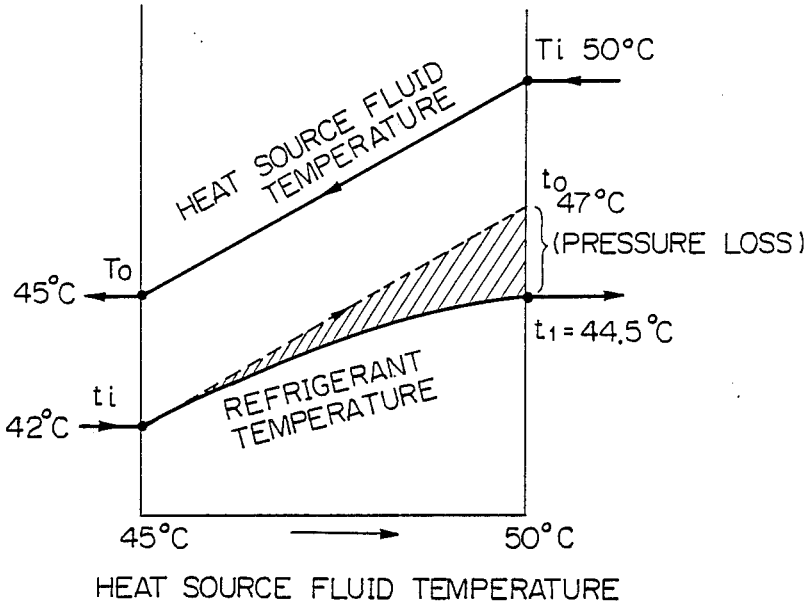
Fig. 2 (PRIOR ART)
FIG. 2 is a graph showing the variation of the evaporating temperature in the prior art.

Regarding the pressure loss, an explanation is given by means of FIG. 2 which shows the temperature variation in the conventional evaporator, wherein the ordinate indicates the temperature and the abscissa indicates the temperature of the heat source fluid. The reason why, instead of using the axial length of the evaporator, the temperature of the heat source is represented in the abscissa is that, if the axial length of the evaporator is shown in the abscissa, the curves for the heat source fluid may vary depending on the conditions and thus comparative review could become difficult. So, the arrangement of FIG. 2 explained above is just for convenience in comparison. The temperature of the heat source fluid is lowered by heat transfer, for example as shown in FIG. 2 from 50° C. ($T_i$) to 45° C. ($T_O$). As to the refrigerant, if it is an ideal refrigerant mixture, the temperature thereof is raised, for example as shown in FIG. 2, from 42° C. ($t_i$) to 47° C. ($t_o$). That is the temperature difference between the two is the same throughout the axial length of the evaporator.

However, in reality as explained above in connection with FIG. 1, there is induced a pressure loss around the region 94, the pressure at the outlet port is lowered compared to the case where the pressure loss is nil by an amount corresponding to that pressure loss, and as a result the boiling point is lowered. Accordingly, the vaporizing temperature t of the refrigerant is lowered by an amount for example 2.5° C. corresponding to that pressure loss, to 44.5° C.

In FIG. 2 the abscissa indicates the temperature of the heat source fluid and does not represent "entropy". Therefore, while the area surrounded by the line representing the refrigerant temperature and the line (not shown) representing the dew point temperature may not quantitatively indicate the amount of work, the fall of the vaporizing temperature from $t_o$(47° C.) to $t_i$(44.5° C.) means that the work corresponding to the area cross-hatched in FIG. 2 is excessive and a corresponding amount of power is lost.

Further, almost complete vaporization of the refrigerant at the region 94 (FIG. 1) adjacent the outlet port means that heat transfer between the refrigerant and the fluid conducting conduit is substantially the transfer between gas-solid which is relatively inferior in heat-transmitting efficiency compared to that between liquid solid and impairs the heat-transfer performance. Also, the refrigerant temperature at the outlet is lowered together with the power loss.

Now, the present invention will be explained using an example of a non-azeotropic refrigerant mixture comprising a high boiling temperature refrigerant CFC 113 (hereinafter, referred to as R-113) and a low boiling temperature refrigerant CFC 114 (hereinafter, referred to as R-114). A similar abbreviation (R. . .) will also be used for another CFC hereinafter.

Figure 3:
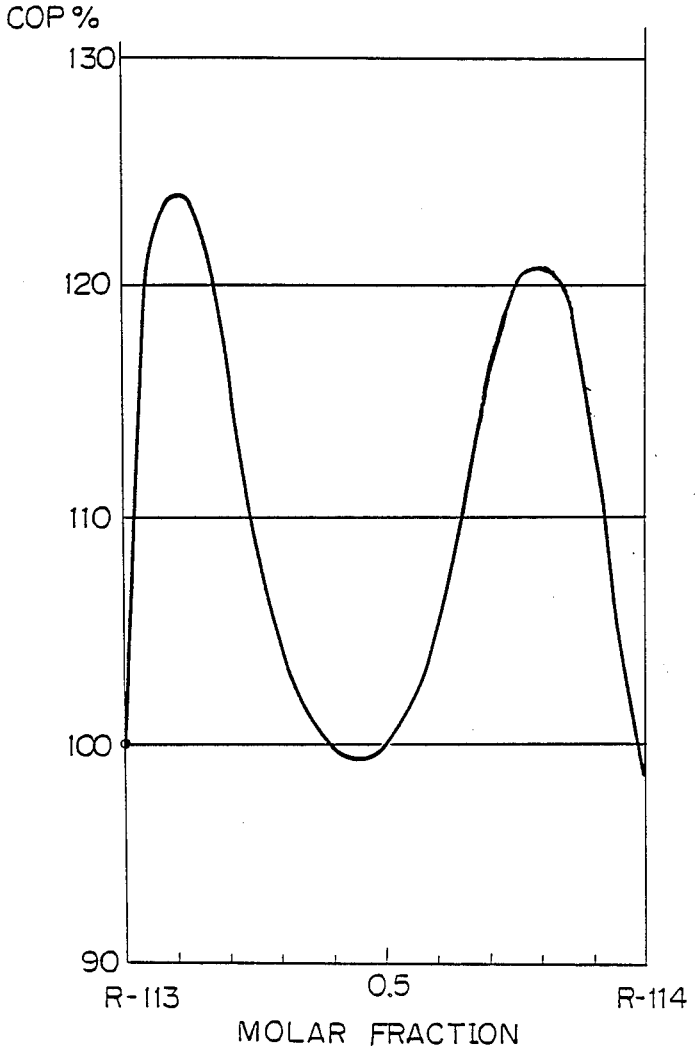
FIGS. 3 through 6 show the relationship between the molar fraction and the COP in several non-azeotropic refrigerant mixtures.

FIG. 3 shows calculated COP (coefficient of performance) of a heat pump cycle under certain conditions employing a non-azeotropic refrigerant mixture of R-113 and R-114. Under these conditions, it exhibits the best COP where the molar fraction of R-113 is approximately 0.9.

Figure 4:
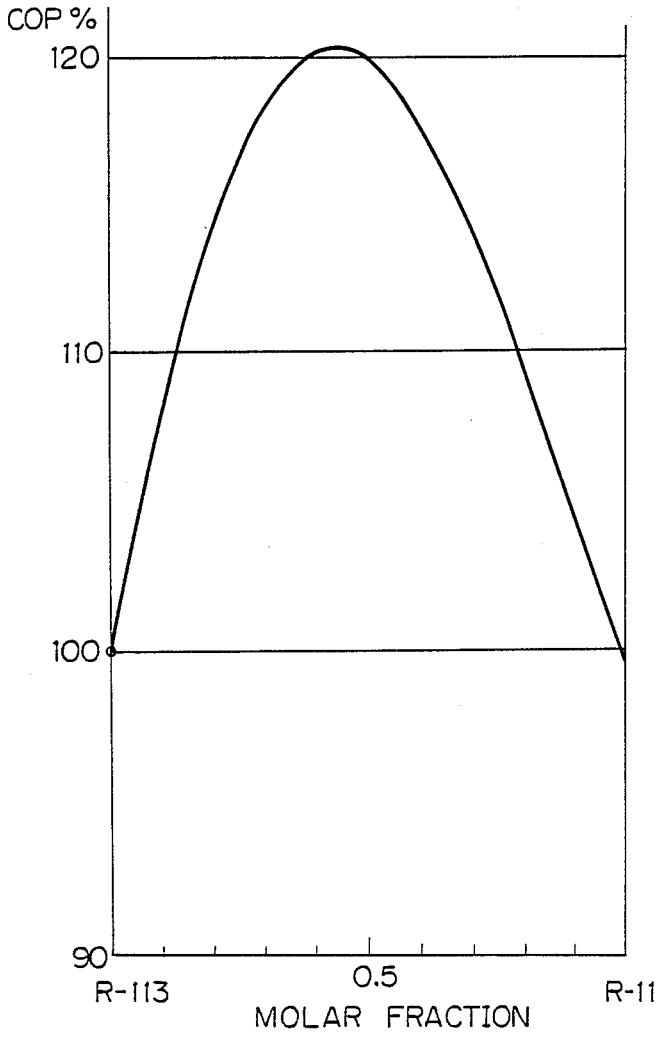
Figure 5:
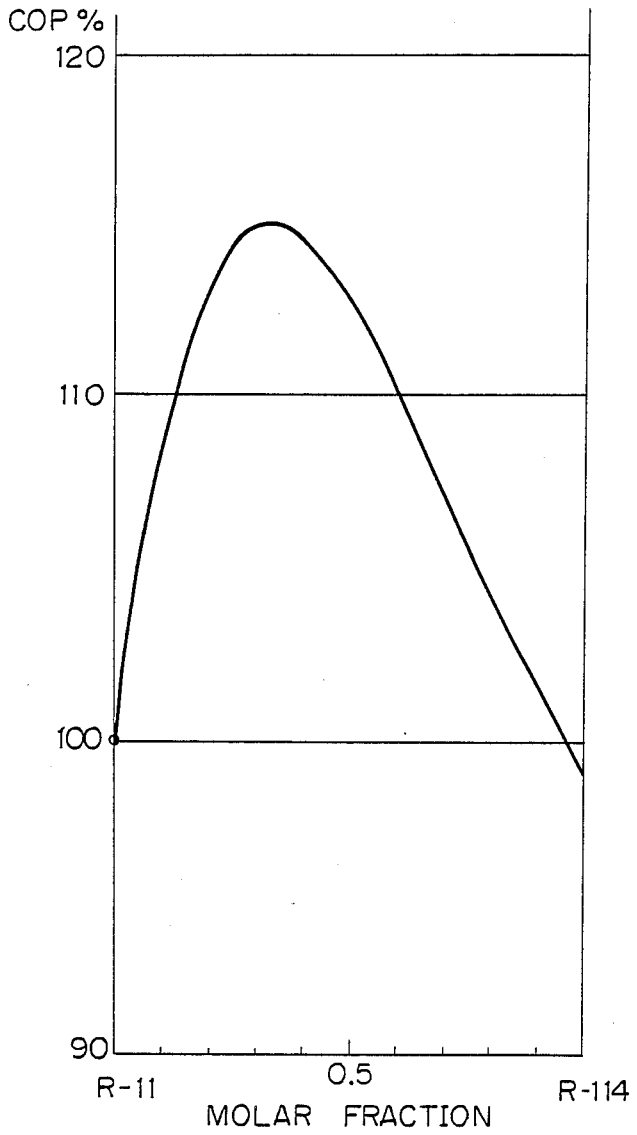
Figure 6:
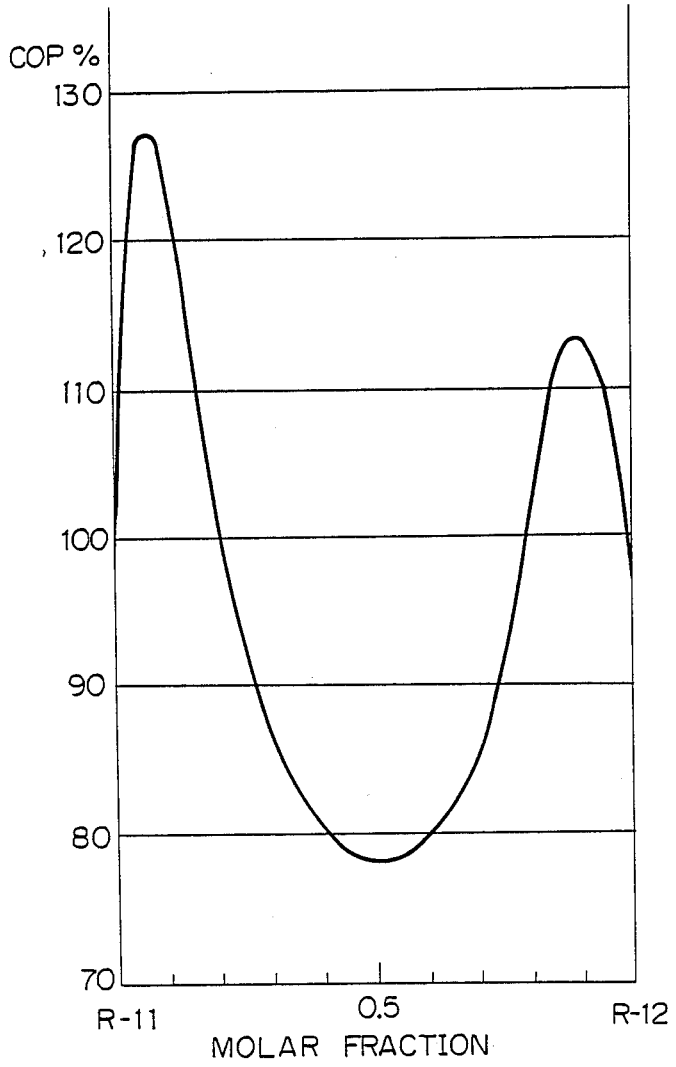

The COP values for other non-azeotropic refrigerant mixtures are shown in FIGS. 4, 5 and 6. FIG. 4 is a case where the mixture comprises R-113 as a high boiling temperature refrigerant and R-11 as a low boiling temperature refrigerant. In this case, the best COP is obtained when the molar fraction of R-113 is approximately 0.55. The COP is best in FIG. 5 when R-11 a high boiling temperature refrigerant, is mixed at a molar fraction of approximately 0.65 with a low boiling temperature refrigerant R-114. FIG. 6 shows the best COP, at a molar fraction approximately 0.93, of a high boiling temperature refrigerant R-11 mixed with a low boiling temperature refrigerant R-12.

As noted above with the practical non-azeotropic refrigerant mixtures, it is found that the maximum value of COP is obtained in the case where the molar fraction of a high boiling temperature contained as a primary component is in the range of over 0.5. Accordingly, as a mixture of refrigerant, it is preferable to use a mixture containing a high boiling temperature refrigerant as a primary component.

Figure 7:
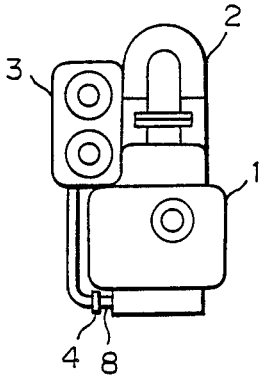
FIG. 7 is shows a side view of a heat pump system.

A complete heat pump system employing the present invention is illustrated in FIG. 7 in a side view wherein 1 designates an evaporator, 2 a compressor, 3 a condenser and 4 a pressure reduction means or throttle valve. The refrigerant condensed at the condenser 3 is reduced in pressure by the pressure reduction means 4 and introduced into the evaporator 1.

The condenser 3 is a counter-flow type but the evaporator 1 is preferably a flooded type at least at a portion adjacent to the outlet. The definition of this type evaporator has been given in the foregoing. (Refer to the latter half of Summary of Invention.) However, for easy understanding, some examples of the evaporator will be explained referring to the drawings.

Figure 8:
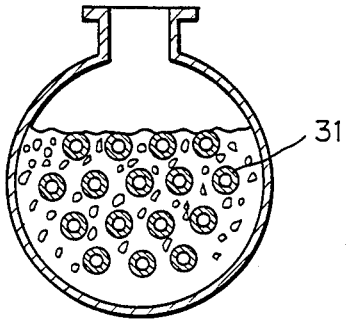
FIGS. 8, 9 and 10 illustrates an example of flooded type evaporators as in the present inventor
Figure 9:
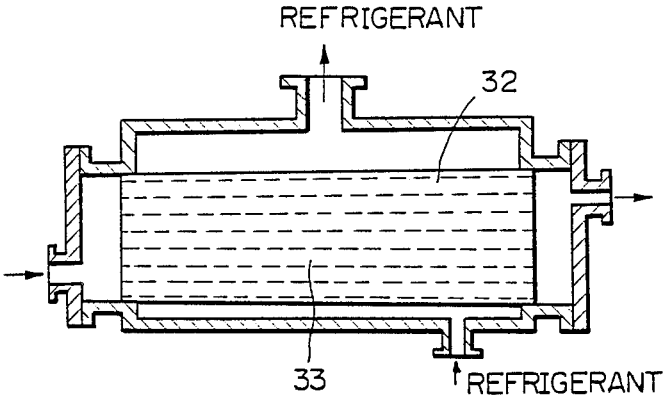
Figure 10:
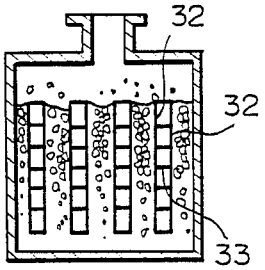

A lateral sectional view of an evaporator 1 is illustrated in FIG. 8 which shows a shell and tube type comprising a plurality of heat transferring tubes 31 and this is an example of a flooded type. However, another type as illustrated in FIGS. 9 and 10, a plate-fin type comprising plates 32 associated with fins, is also a flooded type. Further, if there is no fin 33, it is still included in the category of flooded type.

While the term "flooded" is employed, it is not meant that the heat transferring surfaces are entirely covered with liquid and it includes a type wherein a major part of the upper zone of the heat transferring surfaces are covered with refrigerant vapor and the proportion of liquid therein is small in cases where the specific volume of the refrigerant is large. For example, FIG. 11 shows a sectional view of an evaporator wherein no liquid exists in an upper zone above the heat transferring tubes 31'. This is still a flooded type meeting the criteria defined in the present specification.

On the other hand, FIGS. 12 and 13 are presented to show to what extent the term "counter" or "counter-flow" is interpreted. These drawings illustrate a condenser. In these drawings, fluid passages are detoured around heat transferring tubes 31'' due to the presence of baffle plates 34. This type is also regarded as a counter-flow type in a broad sense.

Figure 15:
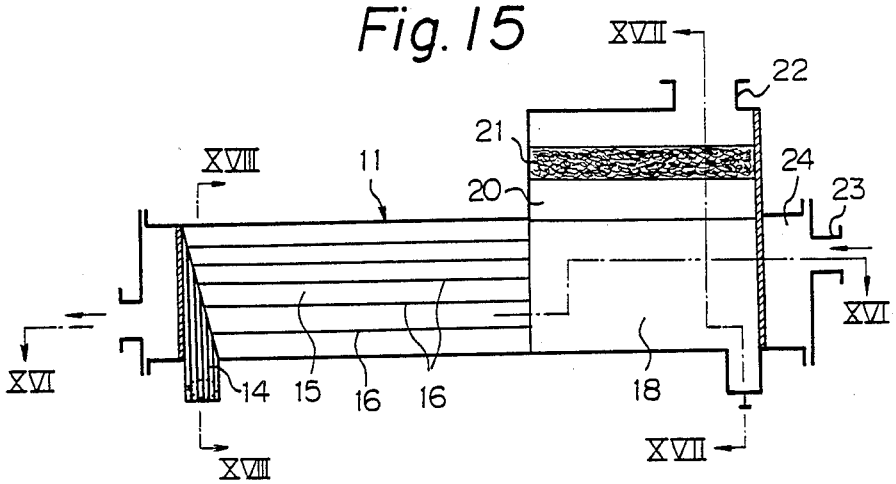
FIG. 15 is a schematic illustration of an evaporator according to the present invention shown in section taken along the line XV—XV in FIG. 16.
Figure 16:
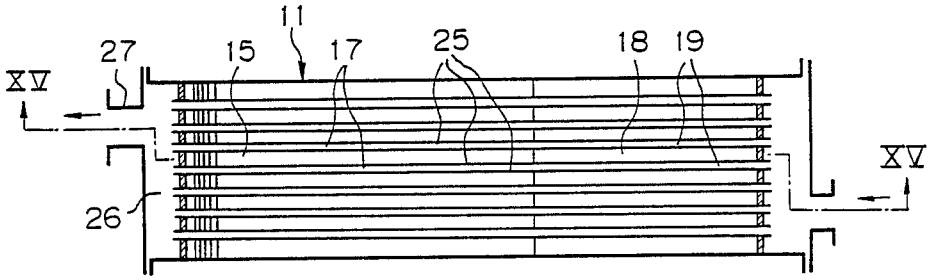
FIG. 16 is shows an axial section of the evaporator taken along the line XVI—XVI in FIG. 15.

Now, referring to FIG. 15, taking an example using a non-azeotropic refrigerant mixture comprising R-113 and R-114 the effect of an evaporator which is a flooded type at least at a portion adjacent to the outlet of the evaporator will be explained.

Figure 14:
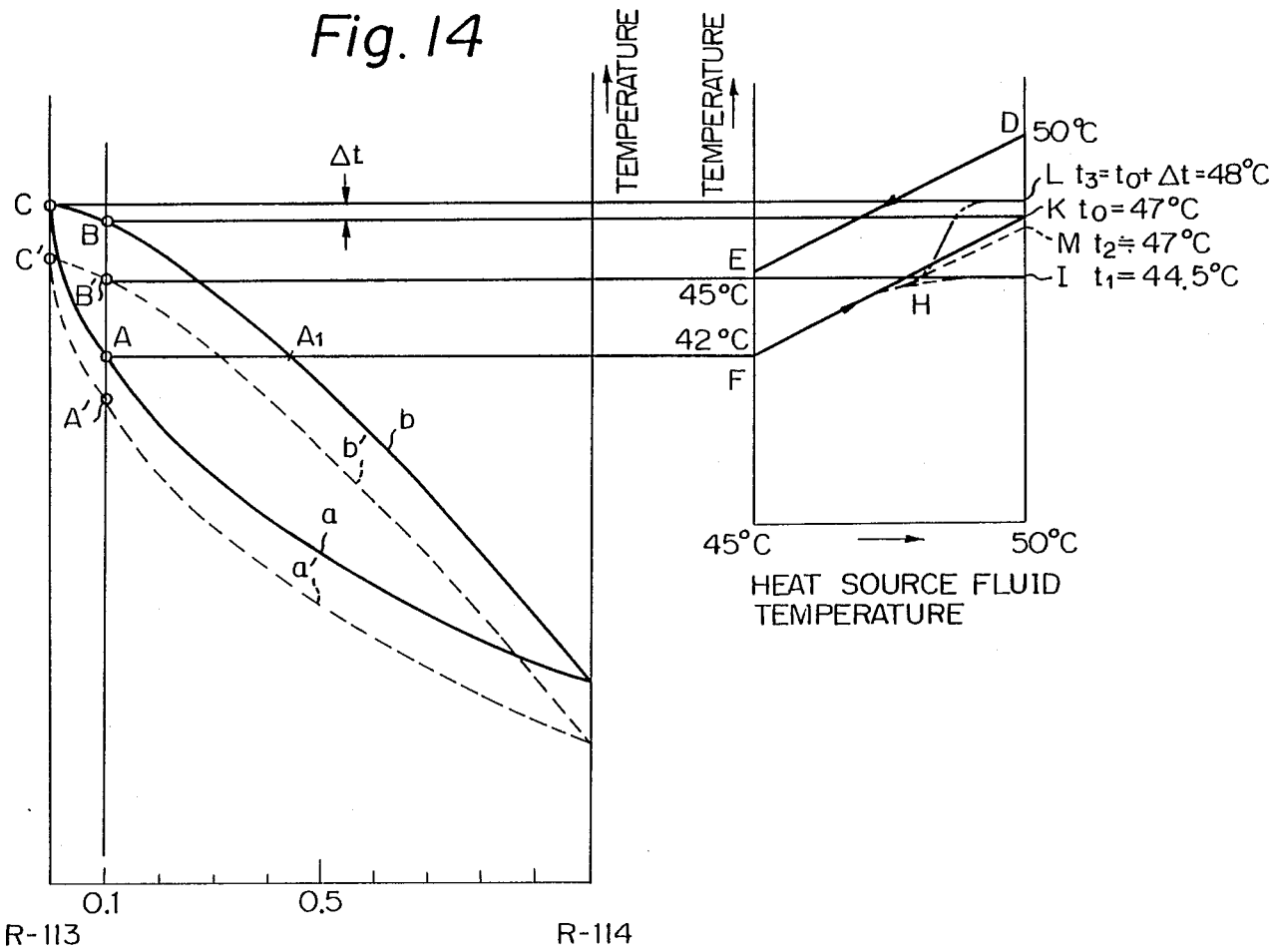
FIG. 14 presents several characteristic curves for comparing the evaporating temperature in the present invention and the prior art, wherein the Left Hand diagram shows Vapor-Liquid equilibrium curves and the Right Hand diagram shows the evaporating temperature relative to the temperature of the heat source fluid.

FIG. 14 illustrates the characteristics when a non-azeotropic refrigerant mixture is used which comprises R-113 as a high boiling temperature refrigerant and R-114 as a low boiling temperature refrigerant with the molar fraction of R-113 at approximately 0.9. The left hand diagram is a vapor-liquid equilibrium diagram and the right hand diagram shows the variation of the temperature within the evaporator.

In the equilibrium diagram, the solid line (a) is a curve representing the boiling point of the mixture and the solid line (b) is a curve representing the dew point at a pressure in an intake port of the evaporator respectively, of the type which is a flooded type at least at a portion adjacent the outlet thereof. The dotted curves (a') and (b') represent the boiling point and the dew point of the mixture respectively at an outlet pressure lower than that of an inlet port in the conventional evaporator which accompanies a pressure loss.

In the present invention, an evaporator is constructed to be a flooded type at least at a portion adjacent the refrigerant outlet and, therefore, there will be no high speed flow of the refrigerant vapor in a narrow passage even at a portion adjacent to the refrigerant outlet where vaporization of the refrigerant having a large specific volume is most active resulting in low resistance in that flow passage and quite small pressure loss.

In order to make the comparison between the present invention and the prior art, it is assumed that the evaporator of this invention is constructed so as to have a counter-flow type construction in the portion upstream from the point H and a flooded type construction in the portion downstream from the point H in the Right Hand diagram of FIG. 14. As to the pressure loss, it is presumed that there is no pressure loss in the portion of the conventional counter-flow type (upstream side) while, downstream from the point H, there is pressure loss in a portion of a conventional counter-flow type construction but no pressure loss in the portion constructed as a flooded type according to the present invention.

Accordingly, regarding the vapor-liquid equilibrium diagram, the solid lines (a) and (b) apply to the portion corresponding to the range from the refrigerant inlet port to the point H. However, for the portion corresponding to the range from the point H to the refrigerant outlet, there is pressure loss in the conventional counter-flow type construction and, thus, the curves for the vapor-liquid diagram are gradually lowered and( at the refrigerant outlet, the curves (a') and (b') are applied while in the present invention (flooded type construction) the curves above are not lowered and the curves (a) and (b) are applied.

First, an example of prior art is touched upon wherein a non-azeotropic refrigerant mixture comprising R-113 at a molar fraction 0.9 is introduced into an evaporator so as to be heated to evaporate by a heat source fluid. When the temperature of the mixture reaches a point $A_l$, evaporation of the mixture commences and vapor having a composition corresponding to $A_l$ is generated. The temperature ($t_l$) at this time is 42° C.

When the refrigerant mixture proceeds further along the flow passage and is raised in temperature, there will be pressure loss due to the flow-passage resistance against the vapor and the pressure gradually drops from at or near the point H and the boiling point curve (a) and the dew point curve (b) are lowered, becoming the curves (a') and (b') at the refrigerant outlet.

The refrigerant mixture under vaporization finally reaches a point B', the point at which the vaporization is complete and therefore terminates. At this time, the temperature of the refrigerant reaches a point I ($t_I$=44.5° C.) through the point H.

In the ideal condition of the counter-flow type evaporator, the temperature at the refrigerant outlet reaches a point K ($t_o$=47° C.). However, in reality there is pressure loss, and the temperature reaches 44.5° C. (point I) showing a temperature 2.5° C. lower than the point K. So there is a temperature drop ($t_o$–$t_i$) associated with the pressure loss resulting in power loss in the compressor.

In contrast to the above, in the evaporator of the present inventor since the range of the evaporator downstream from the point H is constructed to be a flooded type, the temperature and the pressure in that range are substantially uniform and there is no pressure loss whereby there will be substantially no pressure drop so that the vapor-liquid equilibrium curves substantially corresponding to solid lines (a) and (b) are applied in that downstream range. Accordingly, in the case of the present invention, the vaporization completion point would be substantially a point B which corresponds to a point M in the Right Hand diagram of FIG. 14 and its temperature $t_z \approx 47$ ° C. the temperature drop from the point $t_o$ in the ideal condition becomes $t_o - t_z \approx$ O which is smaller by 2.5° C. compared to the case of the conventional evaporator, and thus the power-loss in the compressor is also reduced.

Now the effect on the heat transfer will be explained with respect to a flooded type construction. In the case of the flooded type construction, the surfaces of the heat transmitting conduits facing the refrigerant are always in contact with liquid or at least refrigerant in a state of bubbles effecting alternate contact with vapor and liquid and there is no case where there is only contact with vapor. Therefore, the heat transmitting rate on the refrigerant side is greatly improved in comparison with the conventional evaporator and thus the amount of thermal energy to be transferred is increased. Also, with the effect above, the temperature at the refrigerant outlet may be raised thereby contributing to the reduction of the power loss in the compressor.

As the refrigerants constituting the non-azeotropic refrigerant mixture, the following, for example, may be employed, R-113, R-11 R-114, R-12 and R-22 the listed examples being in the order from that having the highest boiling point to that having the lowest boiling point. The mixture may be a combination of two or more of these.

It is to be noted that the values for the temperature or compositions are merely examples for convenience and they are not to be regarded as factors limiting the present invention.

Some structural explanation of an evaporator according to the present invention will be given referring to the succeeding drawings. FIGS. 15, 16, 17 and 18 show an evaporator in section. The evaporator comprises a shell housing 11 in which refrigerant passages 15 are provided, the passages 15 being in communication with a refrigerant inlet nozzle 8 through distributing passages 13 and 14. The passages 15 are separated by fins 16. As the refrigerant passes through the passages 15, it is heated by a heat source fluid or water passing through heat source passages 17 and is gradually evaporated. For instance, when approximately 70% of the refrigerant is vaporized, it enters an outlet evaporating portion 18 which is of a flooded type construction. In the outlet evaporating portion 18, the refrigerant is further heated by the heat source fluid passing through passages 19 which are the extension of the passages 17 and is completely vaporized, and thence directed to a compressor through a demister 21 provided between an evaporation chamber 20 and an outlet nozzle 22.

The heat source fluid is introduced from an inlet nozzle into a heat source fluid chamber 24 and thence into the heat source fluid passages 19 and 17 where heat transfer is effected between the refrigerant and the heat source fluid through plates 25. The heat source fluid is cooled by the heat transfer and is fed to the outside through a heat source fluid chamber 26 and an outlet nozzle 27.

Figure 17:
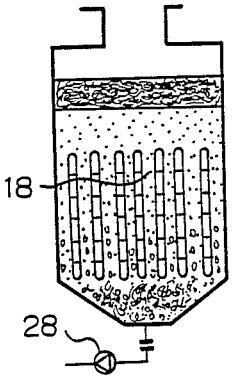
FIG. 17 is a sectional illustration of the evaporator taken along the line XVII—XVII in FIG. 15.
Figure 18:
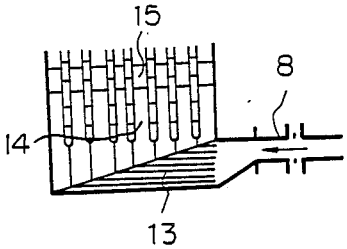
FIG. 18 is a sectional view taken along the line XVIII—XVIII in FIG. 15.

In cases where lubricant, etc. is mixed into the refrigerant, means for removing such foreign matter is provided such as a pump 28 shown in FIG. 17, the pump 28 delivering the mixed refrigerant to an oil separator.

As to the evaporation of the refrigerant, explanation has been given in connection with FIG. 14. With respect to the evaporation of the non-azeotropic refrigerant mixture there may be a case where the high boiling temperature refrigerant R-113 and the low boiling temperature refrigerant R-114 are not uniformly mixed in the outlet evaporating portion 18 as a result of which only the part of the high boiling temperature refrigerant remains there and the evaporation is still continued. In this case, the boiling point may not stay at he point B in FIG. 15 and the temperature of the liquid may be raised to a point C, for example to $t_3 = t_o + \Delta t = 48°$ C. (point L), the point C being the boiling point of R-113. When this happens, the vapor temperature sinks below 47° C. and the refrigerant as a whole is maintained at 47° C. In this case, the amount of thermal energy to be transferred is reduced since the refrigerant temperature approaches the temperature of the heat source fluid (for example, the temperature difference relative to the line ED is smaller in the case of the curve HL than in the case of the curve HM). However, the temperature rise $\Delta t$ is quite small and, thus, this condition does not have any great effect and contrarily, it serves to improve the heat transfer and COP.

If a non-azeotropic refrigerant mixture with a high molar fraction of a higher boiling temperature refrigerant as a primary component thereof is employed, it is possible to make the temperature rise $\Delta t$ smaller compared to a case where a non-azeotropic refrigerant mixture comprising a lower boiling temperature refrigerant as a primary component is employed. So, when a heat pump system is designed aiming its evaporation terminating point at the point B, for example, it is possible in the former case to reduce the reduction in the amount of the thermal energy to be transferred due to the temperature rise $\Delta t$ of the boiling point of the refrigerant.

Also( in selecting the refrigerant mixture, if a mixture comprising a higher molar fraction of a primary component (i.e. a high boiling temperature refrigerant) than that exhibiting the highest COP is chosen, the temperature rise $\Delta t$ is made quite small thereby further reducing the reduction in the amount of the thermal energy to be transferred.

Figure 19:
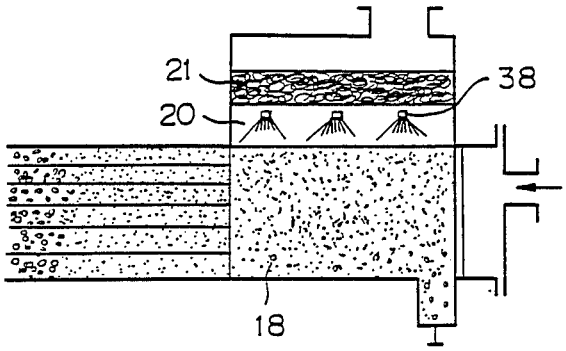
FIG. 19 shows a part of another evaporator in an axial section.
Figure 20:
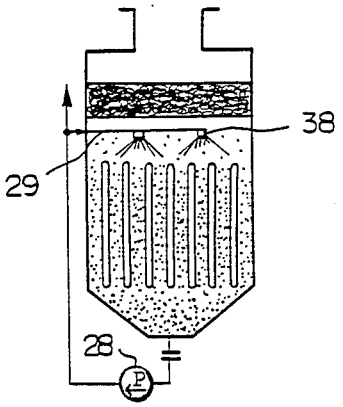
FIG. 20 is a transverse section of the evaporator shown in FIG. 19.

FIGS. 19 and 20 show an improvement over the evaporator shown in FIGS. 15, 16, 17 and 18. In this evaporator, a part of the liquid fed from the pump 28 is directed to a conduit 29 and sprayed through spraying nozzles 38 in the outlet evaporating portion 18. With this spraying arrangement, not only is improvement in the heat transferring performance produced but also the possibility of the high boiling temperature refrigerant remaining in the outlet evaporating portion 18 is reduced and thus the occurrence of the temperature rise $\Delta t$ of the boiling point is prevented, leading to the prevention of the reduction of the thermal energy to be transferred.

Figure 21:
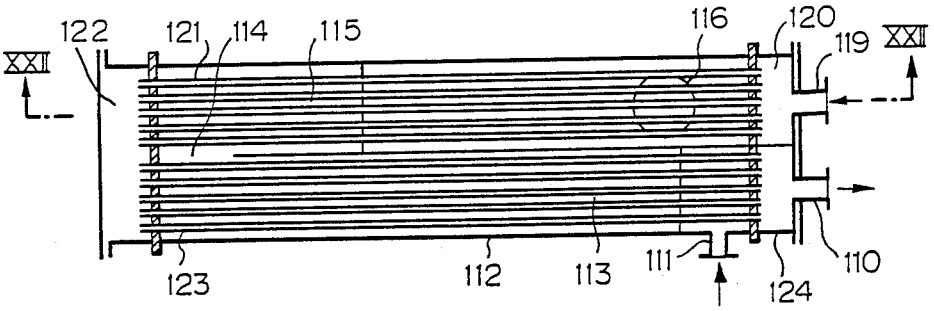
FIG. 21 is an axial section of another evaporator.
Figure 22:
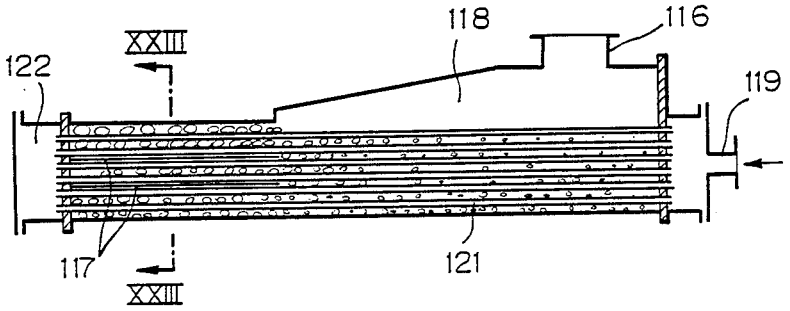
FIG. 22 is a sectional view taken along the line XXII—XXII in FIG. 21.
Figure 23:
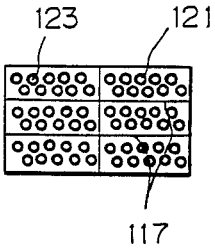
FIG. 23 is a sectional view taken along the line XXIII—XXIII in FIG. 22.

FIGS. 21, 22 and 23 show another embodiment of an evaporator 112 according to the present invention. This embodiment is a shell and tube type. The refrigerant is introduced through an inlet nozzle 111 and passed through first passages 113 in a counter-flow fashion, after which the refrigerant's direction of flow is changed in a turning portion 114 and the refrigerant is fed through second passages 115 also in a counter-flow fashion. The refrigerant is, finally completely vaporized and sucked into a compressor through an outlet nozzle 116. There are provided plural partition plates 117 vertically arranged in order to improve the heat transfer performance. Of course, a portion adjacent the outlet nozzle is constructed to be a flooded type construction. That is, a vapor chamber 118 is provided above heat transferring conduits 121 and the pressure and the temperature of the refrigerant are maintained substantially uniform. The heat source fluid is introduced into the conduits 121 from an inlet nozzle 119 through a first heat source fluid chamber 120, cooled by heating the refrigerant and fed into a second heat source fluid chamber 122. The heat source fluid is thence directed outwards through heat transferring conduits 123, a third heat source fluid chamber 124 and an outlet nozzle 110.

Figure 24:
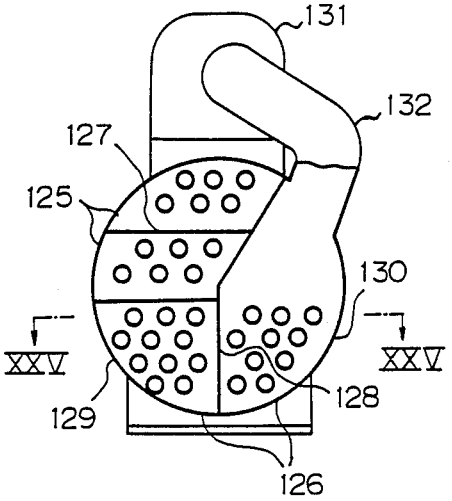
FIG. 24 is a side view of another heat pump system.
Figure 25:
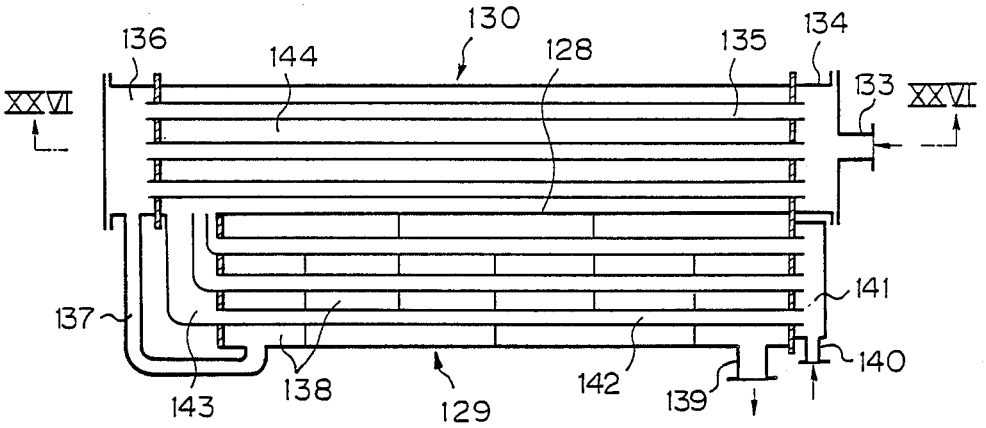
FIG. 25 is a sectional view taken along the line XXV—XXV in FIG. 24.
Figure 26:
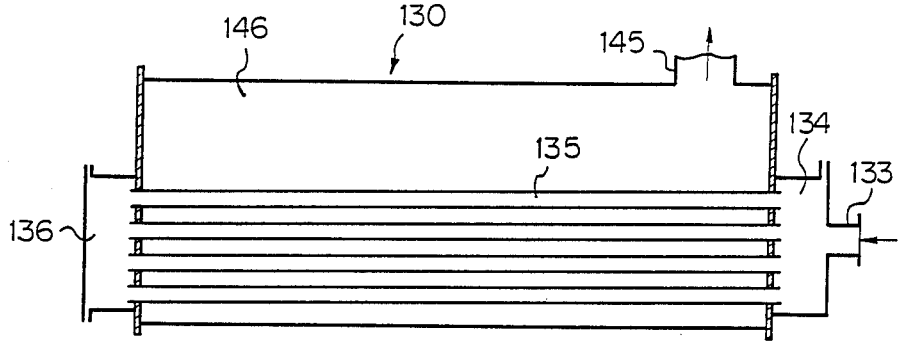
FIG. 26 shows a sectional view taken along the line XXVI—XXVI in FIG. 25.

FIGS. 24, 25 and 26 show another embodiment according to the present invention. In this embodiment, a condenser 125 is divided by a partition 127 and an evaporator 126 is also divided by a partition 128. The condenser 125 is constructed as a type wherein condensation as a whole is effected outside the conduits. On the other hand, the evaporator 126 is constructed to comprise an evaporating section 129 which is arranged as a counter-flow type wherein evaporation is effected within conduits and an evaporating section 130 which is a flooded type. In FIG. 24, 131 represents a compressor and is coupled with the evaporating section 130 through a suction pipe 132.

Into the evaporator 126 the heat source fluid is introduced from an inlet nozzle 133 and passed through a fluid chamber 134, heat transfer conduit tubes 135, a fluid chamber 136 and a communication pipe 137 and thence to an outlet nozzle 139 and, during the above passage of the heat source fluid, it heats the refrigerant. Regarding the refrigerant flow, it is introduced from an inlet nozzle 140 and passed through a header 141, heat transfer conduits 142, a communication passage 143 and shell internal portion 144 where it is heated by the heat source fluid in the heat transfer conduit tubes 135 extending through the portion 144 and evaporated into a vapor chamber 146. The refrigerant vapor is thence sucked into the compressor 131 through an outlet nozzle 145. In this evaporator, it is advantageous that the height of the portion where the communicating passage 143 is coupled to the flooded type evaporating section be arranged at an optimum position. If this coupling point is at a lower position, the pressure-loss may become large, and if it is too high, the agitation effect may be reduced.

Figure 27:
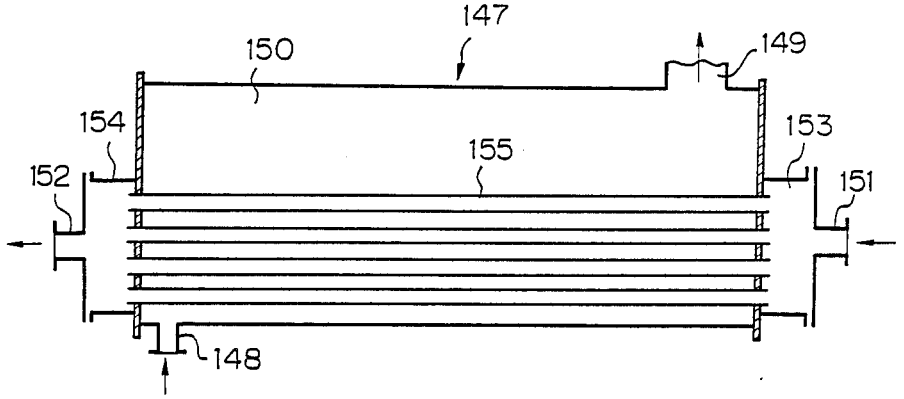
FIG. 27 illustrates another evaporator in an axial section.

FIG. 27 illustrates an evaporator 147 which is entirely a flooded type. The refrigerant is introduced into it from an inlet nozzle 148 and fed outwards from an outlet nozzle 149 through a vapor chamber 150 where heat transfer is effected between the heat source fluid and refrigerant the heat source fluid passing from an inlet nozzle 151 to an outlet nozzle 152 through a fluid chamber 153, heat transfer tubes 155 and a fluid chamber 154. In this type of evaporator, the temperature of the refrigerant within the evaporator may become substantially uniform but the low boiling temperature refrigerant component of the refrigerant mixture violently evaporates at a portion adjacent to the inlet thereof and, thus, the temperature of the heat source fluid abruptly drops at the portion adjacent to the outlet.

Now, the solution for unfavorable stagnation of the component refrigerant mixture in the heat pump system will be discussed.

Figure 28:
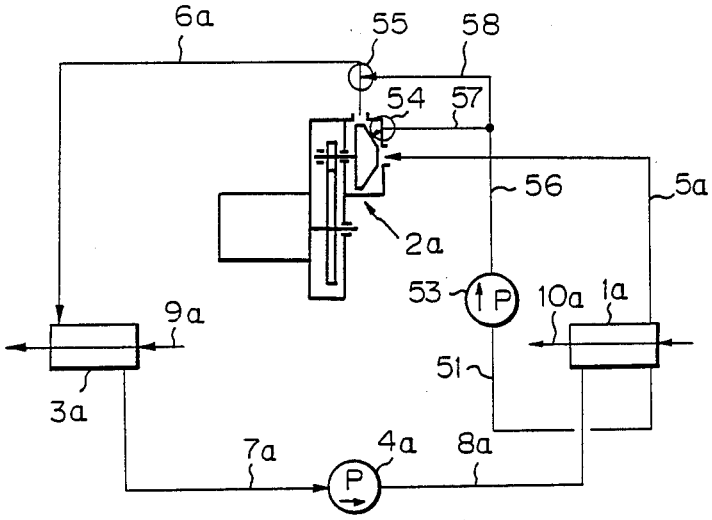
FIG. 28 diagramatically illustrates an example of a heat pump system according to the present invention.

In FIG. 28, a heat pump system for solving the problem according to means (c) noted in the Summary is diagramatically shown wherein l*a* is an evaporator 2*a* a compressor, 3*a* a condenser, and 4*a* a pressure reduction means or throttle valve. Conduits 5*a*, 6*a*, 7*a* and 8*a* couple the above elements l*a*, 2*a*, 3*a* and 4*a* for passing the refrigerant. Assuming that the system is used as a heating system for producing hot water ( a line 9*a* indicates a conduit for a heat sink fluid and a line 10*a* indicates conduit for a heat source fluid.

Figure 29:
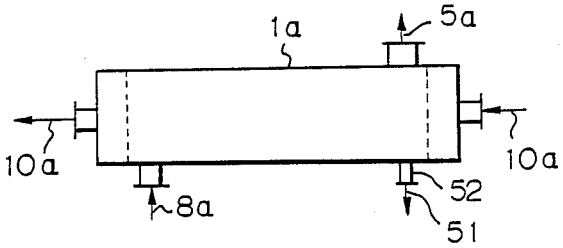
FIG. 29 is an explanatory drawing for the evaporator in FIG. 28.

At a lower part of the evaporator la where a refrigerant mixture in liquid state, which is rich in regard to a high boiling temperature refrigerant component, likely stagnates or stays, a refrigerant extracting passage 51 is coupled to the evaporator la through a nozzle 52 as shown in FIGS. 28 and 29 so that a part of the stagnating liquid can have its pressure raised by a pump 53 and sprayed into an inside portion (at an intermediate pressure) or a portion adjacent to an outlet of the compressor 2*a* (at a high pressure) through spraying devices 54 or 55, respectively vaporized and merged into the refrigerant circulating path, the devices 54 and 55 being coupled to the pump through passages 56, 57 and 58. The spraying devices 54 and 55 serve as a means for effecting evaporation of a liquid refrigerant rich in regard to a high boiling temperature refrigerant.

With the system explained in connection with FIGS. 28 and 29, the heat transfer performance within the evaporator l*a* is not degraded and is maintained efficiently since the liquid refrigerant mixture rich in regard to a high boiling temperature refrigerant component and likely to stagnate at the portion adjacent to the nozzle 52 may be removed by means of the pump 53. The removed liquid refrigerant, upon merging into the circulating path through spraying devices 54 and 55, cools the discharged gaseous vapor from the compressor 2*a* by evaporation. Due to this cooling effect, it is made possible to secure the stability of the refrigerant particularly in the case of the high temperature heat pump where the refrigerant temperature at the outlet of the compressor may exceed the usable limit for that refrigerant.

As to the location of the spraying devices 54 and 55 as a means for portion effecting evaporation, it may be a single position or plural positions and optionally determined provided that it is selected to be in a vapor zone in the refrigerant circulating passage between the evaporator la and the condenser 3*a*. In case of plural positions or locations, a number of passages equivalent to the passage 51 can be provided each being independent.

Figure 30:
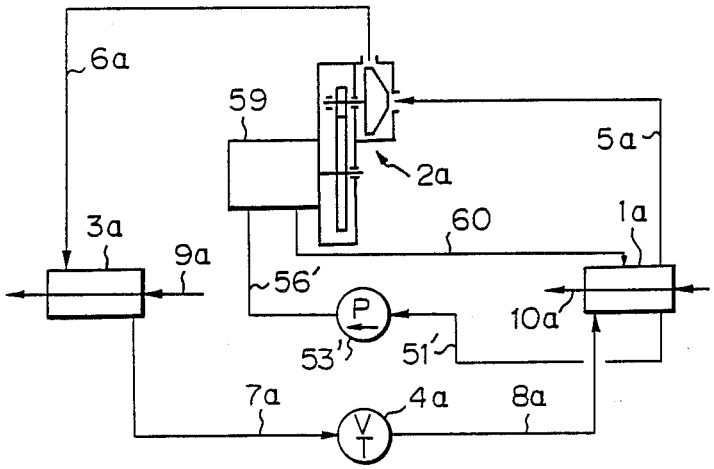
FIGS. 30, 31, 32, 33, 34 and 35 show examples similar to FIG. 29.

FIG. 30 diagramatically illustrates another embodiment of a heat pump system according to the present invention. In this embodiment, the same references as those in FIG. 28 and 29 are used for the elements whose functions are the same in both embodiments. A motor 59 driving the compressor 2*a* is of a type which is cooled by the refrigerant within the system.

The non-azeotropic refrigerant mixture in liquid state, which is rich in regard to the high boiling temperature refrigerant, is sucked into an extracting passage 51', its pressure raised by means of a pump 53' and fed through a passage 56' into a casing of the motor 59 where the liquid refrigerant evaporates to cool the inside of the motor. The vapor thus evaporated in the motor casing is returned to the evaporator la through passage 60 and merged into the vapor evaporated in the evaporator l*a* from where the merged vapor is sucked into the compressor 2*a*. In this embodiment, the inside portion of the motor 59 serves as an evaporating means.

Figure 31:
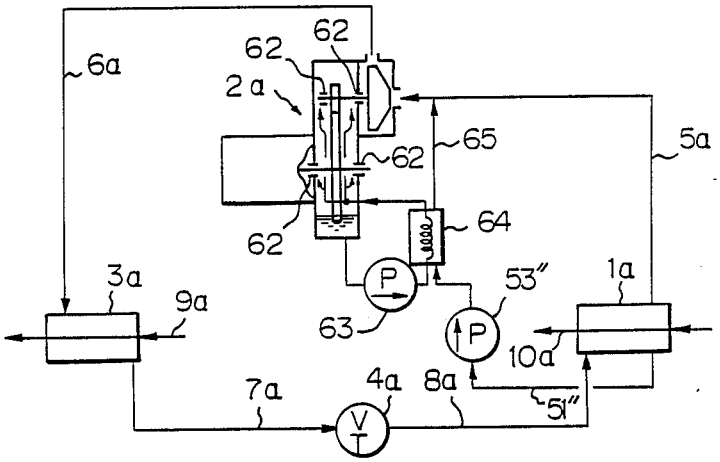

FIG. 31 illustrates still another embodiment of a heat pump system according to the present invention where stagnation o refrigerant mixture liquid in the evaporator is to be solved. In FIG. 31, the same references are employed in a manner similar to FIG. 30. In this case, the embodiment represents the case where the lubricant for bearings 62 of the compressor la is circulated through an oil cooler 64. The refrigerant mixture in liquid state, which is rich in regard to the high boiling temperature refrigerant is sucked into an extracting passage 51'' from the evaporator 1*a* and its pressure is raised by means of a pump 53''. The pressurized liquid refrigerant is fed into the oil cooler 64 where the refrigerant is evaporated to cool the lubricant circulating therethrough from the bearings 22 to an oil sump of the compressor 2*a* and the oil cooler 64 by means of a pump 63. The refrigerant vapor evaporated in the oil cooler 64 is sent into the refrigerant passage 5*a* through a passage 65 and sucked into the compressor 2*a* for circulation in the system. In this case, the oil cooler 64 serves as an evaporating means. In the embodiments explained in connection with FIGS. 28 through 31, the pumps 53, 53' and 53'' are used for raising the pressure and delivering the pressurized refrigerant; however, in lieu of such employment of the pumps, an ejector utilizing delivery pressure or refrigerant vapor under condensing pressure in the system may be employed. It is also to be noted that the evaporator 1*a* need not necessarily be a flooded type as explained in the preceeding embodiments.

With respect to the embodiments shown in FIGS. 30 and 31, there may be further possible modifications in sending the refrigerant evaporated in the evaporating portion such as coupling the refrigerant passages 60 or 65 to the refrigerant passage 5*a* by providing a throttling portion in the passage 5*a* where the passage 60 or 65 is to be coupled, utilizing a capillary phenomenon to pass the refrigerant by making the refrigerant passages capillary tubes or utilizing gravity to feed the refrigerant by placing the evaporator 1*a* at a position higher than the compressor 2*a*.

The explanation has been given for the cases where the compressor is a single stage type; however it may be a plural stage type. Also, any type of compressor such as a centrifugal type, a reciprocating type, a screw type or a roots type, etc. may be used.

Now, the solution for solving the problem in the condenser of the heat pump system using the non-azeotropic refrigerant mixture will be discussed.

Figure 32:
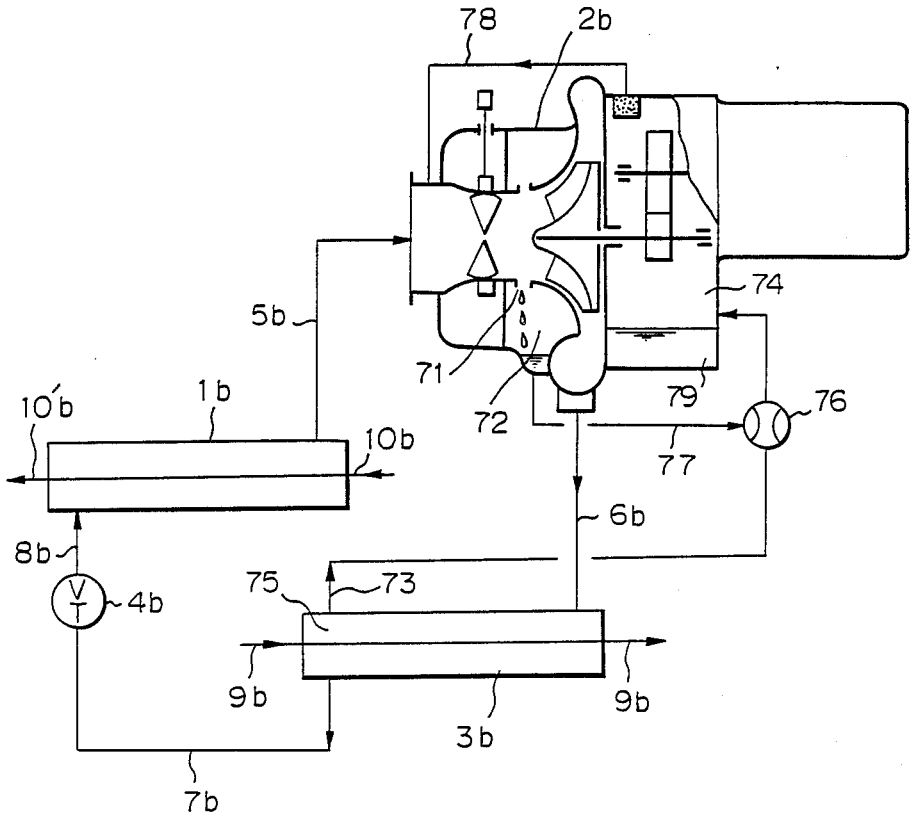

An embodiment for such end is diagramatically illustrated in FIG. 32 wherein the main elements of the heat pump system are given the same references as those in the embodiments in FIGS. 28 through 31 except that they are accompanied by suffix "b" in place of "a" in the foregoing embodiments. At an inlet or suctioning portion of the compressor 2*b*, an oil recovery passage 71 is coupled to recover lubricant mixed into the refrigerant at a portion downstream of a suctioning vane adapted to regulate the suctioning flow rate of the compressor 2*b*. In cases where the suctioning flow rate of the compressor 2*a* is 100 %, the direction of the suctioning vane is approximately parallel to the suctioning axial direction but, if the flow rate is to be throttled, the direction of the vane, becomes unparallel to the suctioning axial direction and, thus, the mist of the lubricant strikes against the vane, its droplet size thereby being increased and introduced to the recovery passage 71. The lubricant is thence fed to an oil sump 72 of the compressor 2*b*.

In the condenser 3*b*, an extracting passage 73 is coupled to an outlet portion 75 thereof so as to extract the uncondensed refrigerant vapor and direct it to an oil tank 74 of the compressor 2*b*. Due to the provision of the extracting passage 73, stagnation of the uncondensed vapor is solved and, thus, the tendency of the vapor density of the lower boiling temperature refrigerant to become denser and denser at the outlet portion 75 thereby reducing the heat transferring efficiency of the condenser is avoided and that efficiency is considerably improved.

In the passage 73, an ejector 76 is provided which is arranged to suck the lubricant temporarily retained in the sump 72 through a conduit 77 and feed it to the oil tank 74. Incidentally, the pressure in the tank 74 is maintained at a pressure approximately equivalent to a suctioning pressure by means of a balancing conduit 78.

Figure 33:
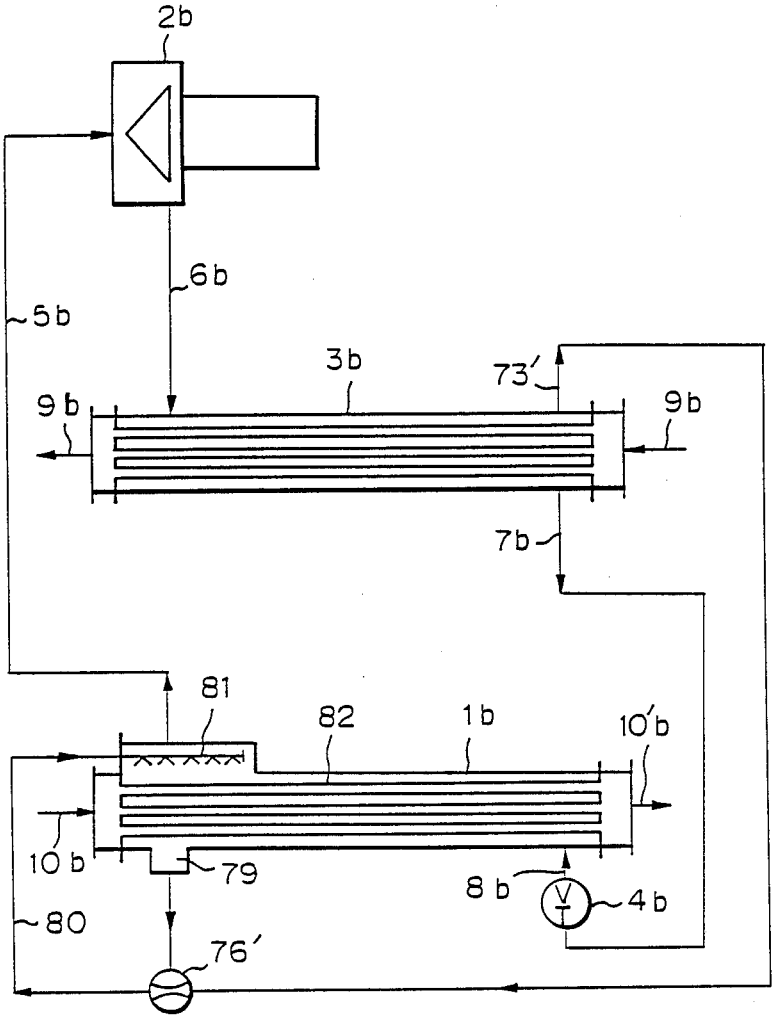

FIG. 33 illustrates yet another embodiment wherein the same references are employed to indicate the same elements bearing the same references in FIG. 32. At an outlet portion of the condenser 3*b* an extracting passage 73' is coupled to the condenser 3*b* so as to extract the uncondensed refrigerant vapor tending to stagnate at an outlet portion of the condenser and feed it to an ejector 76' provided in the passage 73'. The ejector 76' is arranged to suck unevaporated refrigerant tending to stagnate at the bottom 79 of an outlet portion of the evaporator lb and feed the refrigerant in a mixed vapor liquid state through a conduit 80 to a spraying nozzle 81 provided at an upper portion of the refrigerant outlet portion of the evaporator 1*b*. The mixed refrigerant sprayed from the nozzle 81 is directed over the heat source fluid tubes 82. Since the sprayed refrigerant mixture contains liquid in a relatively large proportion, the heat transferring efficiency at the outlet portion of the evaporator l*b* is improved. Further the provision of the spraying nozzle 81 induces a so-called "agitating effect" and prevents the ratio of the high boiling temperature refrigerant contained in the non-azeotropic refrigerant mixture at the outlet portion from being increased, a problem which usually occurs in the conventional evaporator using the non-azeotropic refrigerant mixture.

Figure 34:
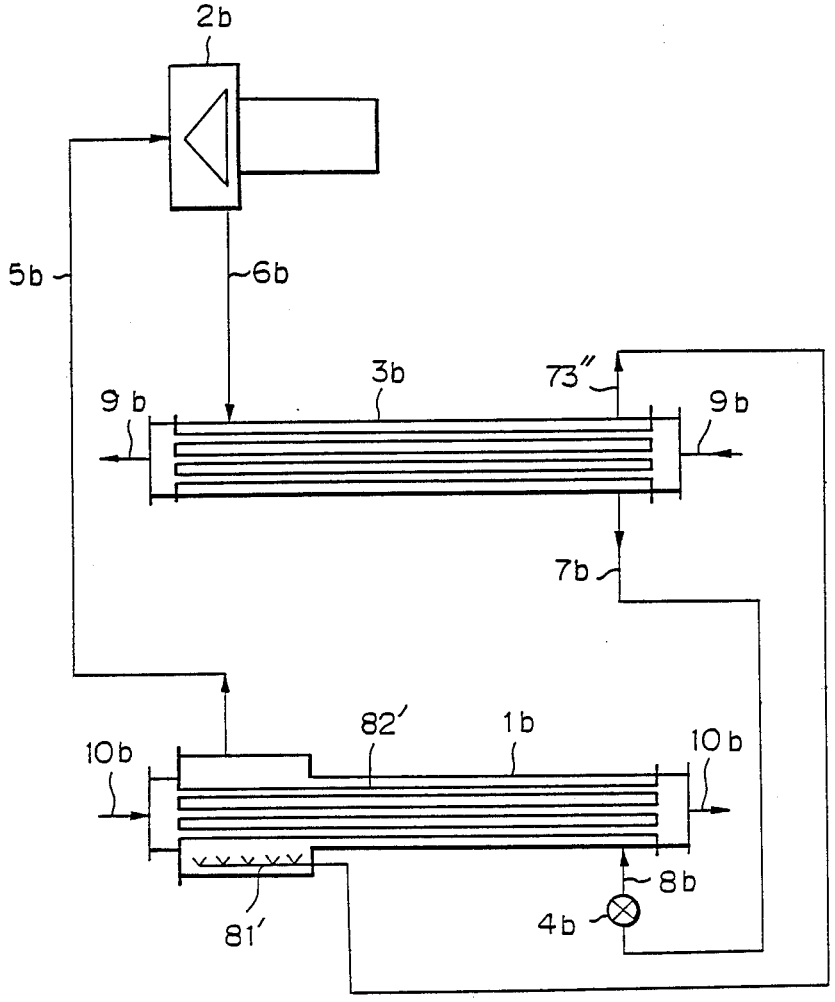

FIG. 34 illustrates a modified form of the embodiment shown in FIG. 33. What is different from FIG. 33 in this modification is that uncondensed refrigerant from the condenser 3*b* is sprayed upwards from a lower spraying nozzle 81'provided at a lower portion in a refrigerant outlet portion of the evaporator 1*b* in contrast to the nozzle 81 provided at an upper portion in FIG. 33. That is, a plurality of perforations in the nozzle 81' facing upwards serve to inject the uncondensed refrigerant vapor upwards so that the refrigerant stagnating in liquid state at the lower portion of the refrigerant outlet portion of the evaporator 1*b* which is rich in regard to the high boiling temperature refrigerant is also blown upwards thereby improving the heat transferring efficiency of tubes 82'. Therefore, in cases where the number of stages for the tubes 82' in small it is still possible to attain an efficiency approximately equivalent to that attained in the system illustrated in FIG. 33.

Figure 35:
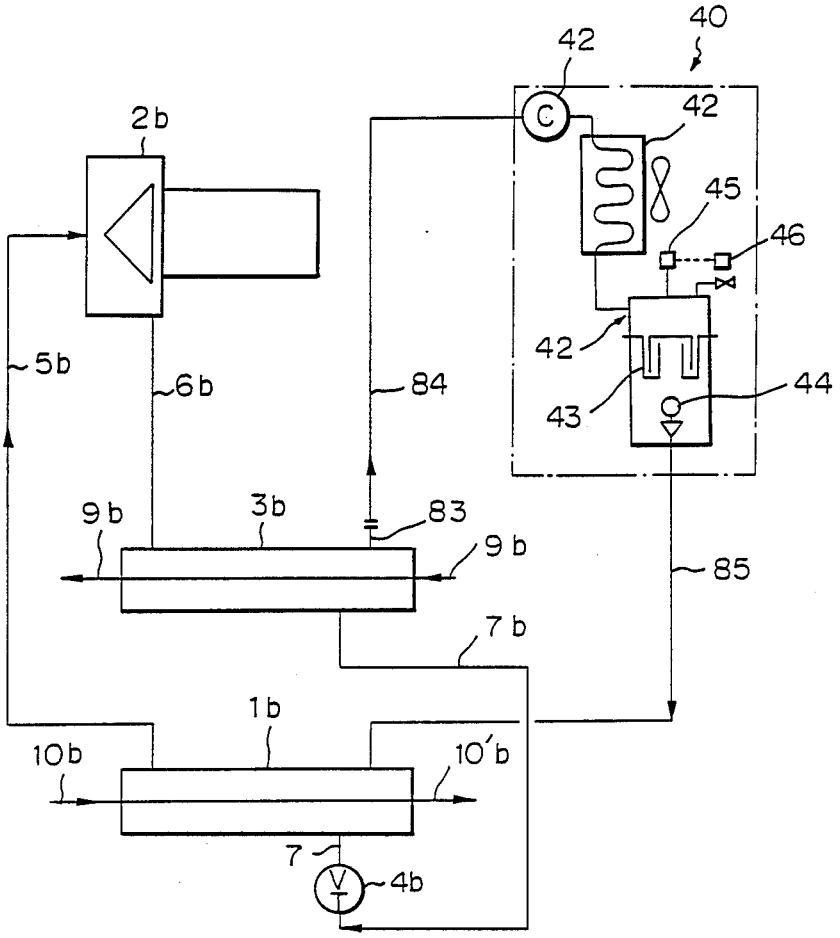

FIG. 35 illustrates a still further modification of the heat pump system according to the present invention. At an upper part of the refrigerant outlet portion of the condenser **3*b*, an extracting nozzle 83 is provided so as to remove air entrained into the heat pump system and direct the air to an evacuation device 40 through a conduit 84 so that the entrained air is removed from the system. At the same time, the low boiling temperature refrigerant stagnating at the upper portion of the refrigerant outlet of the condenser 3*b* is also extracted from the nozzle 83. As to the evacuation device 40, several types are available. In FIG. 35**, an air-cooling type is shown.

The evacuation device 40 shown in FIG. 35 is constructed to comprise a small sized compressor 41, an air cooling subcompressor and a separator 42'. The air containing the low boiling temperature refrigerant from the nozzle 83 is introduced through a conduit 84 into the evacuation device 40 wherein the air is compressed by the compressor 41 and thence the refrigerant contained in the air is condensed and led into the separator 42. The refrigerant introduced into the separator 42 flows through a water separator 43 to a lower portion of the separator 42 where it stays and thence until it passes through a float valve 44 and returns to the evaporator 1b through a conduit 85. If air is accumulated in the upper portion of the separator 42 and the pressure in the separator 42 is raised, a pressure switch 45 is actuated to actuate an electro-magnetic valve 46 for exhausting the air. The refrigerant returning to the evaporator **1*b* is led to the portion of the evaporator 1*b*. adjacent to where the inlet for the refrigerant from the main passage 7*b* is coupled to the evaporator 1*b*. This is because the returned refrigerant from the evacuation device 40** has the low boiling temperature refrigerant as its primary component, which component may easily evaporate where the temperature of the heat source fluid is lowered.

In the illustration, the sub-condenser 42' is shown as an air-cooling type, but it may be another type, such as one utilizing, for the purpose of cooling, latent heat of the refrigerant by evaporating the condensed refrigerant.

Figure 36:
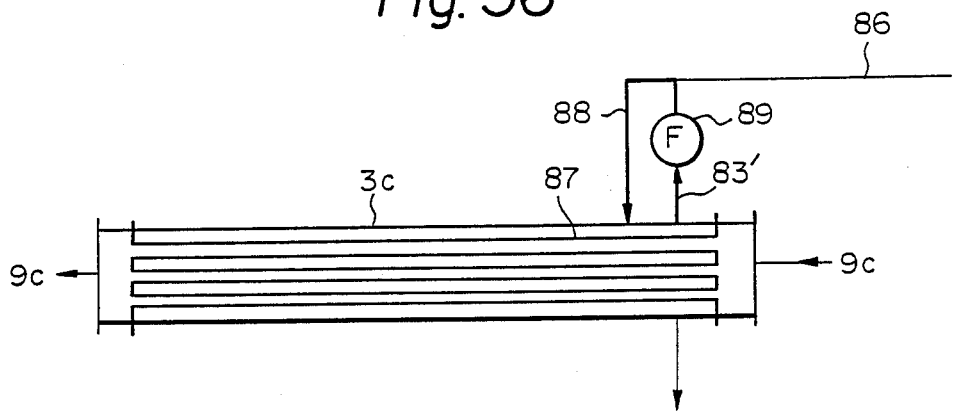
FIG. 36 is an explanatory drawing regarding a condenser.

FIG. 36 shows a modified condenser **3*c* in which a heat sink fluid line 9*c* is provided by tubes or conduits 87. From an extracting port 83', uncondensed refrigerant is extracted and raised in pressure by means of a fan 89 and re-introduced into the condenser 3*c* through a conduit 88 at the portion of the condenser 3*c* where the outlet port for the refrigerant is located. By this arrangement, the refrigerant vapor is blown over the tubes 87 at the portion adjacent the refrigerant outlet so as to remove films of the low boiling temperature refrigerant formed on the surfaces of the tubes 87 and to agitate the refrigerant vapor at the refrigerant outlet portion thereby preventing the condensing temperature from being lowered. The fan 89 may be incorporated internally into the condenser 3*c***.

Figure 37:
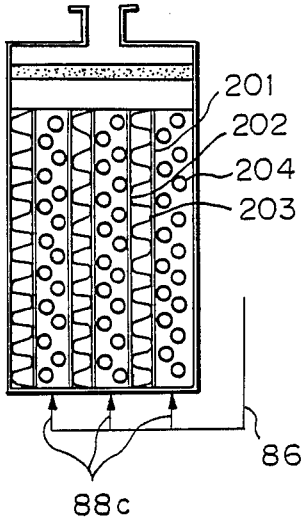
FIG. 37 is a section of a plate-fin type condenser taken along the line XXXVII—XXXVII in FIG. 38.
Figure 38:
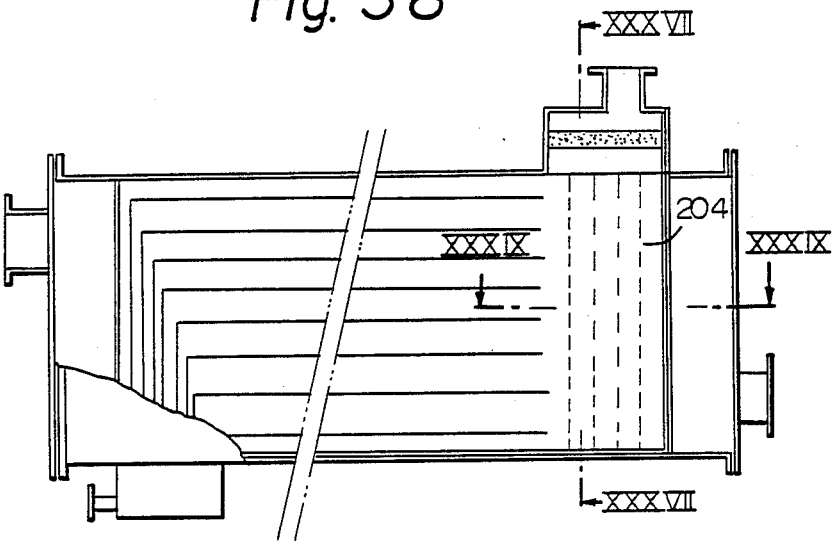
FIG. 38 is an axial section of the condenser shown in FIG. 37.
Figure 39:
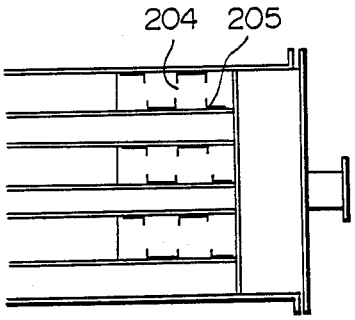
FIG. 39 is a sectional view taken along the line XXXIX—XXXIX in FIG. 38.

In a case where the pressure difference between the condenser (**3*c*) and the evaporator (1*b*) is small, it is advantageous to feed, as shown in FIG. 37 which is the sectional view of the condenser 3*c* the refrigerant vapor to injection tubes 88*c* through a conduit 86 which is the one shown in FIG. 36. In this case, compared to the embodiment shown in FIG. 34, an effect almost the same as that of FIG. 34 is obtained even if the injected amount is smaller. Some further sectional views of the condenser 3*c* are shown in FIGS. 38 and 39. In FIGS. 37, 38 and 39, a plate-fin type condenser is shown wherein 201 and 202 are plates, and 203 indicates fins provided for the heat sink fluid side. At the portion adjacent the refrigerant outlet, fins 205 are provided vertically and the fins 205 are provided with a plurality of perforations 204 so that the refrigerant may freely pass therethrough. The fins 205** are, thus, provided primarily to reinforce the structure.

As explained above referring to the embodiments, there are many advantages obtained in that:

1. in a case where at least the portion adjacent to the refrigerant outlet of the evaporator is a flooded type, power loss may be minimized; and an economical pressure reduction means such as a manual expansion valve or an orifice may be employed; and 2. the ratio of the components contained in the non-azeotropic refrigerant mixture is stably maintained so that the heat transfer efficiency of the heat pump system may be kept in a good condition.

While the present invention has been explained in detail referring to the specific embodiments and data, it should be noted that the present invention is not limited to those explained and modifications and changes thereof may be effected by those skilled in the art within the spirit and scope of the present invention defined in the claims appended hereto.

What is claimed is:

1. A heat pump system comprising:
a compressor means;
a condenser;
an evaporator;
a pressure reduction means;
refrigerant circulating passage means connecting said compressor means, said condenser, said evaporator and said pressure reduction means;
a refrigerant in said system;
means for circulating said refrigerant in said system to effect a heat pump cycle;
said refrigerant being a non-azeotropic refrigerant mixture;
said system further having a further evaporating means; and
means for extracting unevaporated refrigerant from said evaporator and supplying it to said further evaporating means and then supplying the refrigerant evaporated in said further evaporating means to said compressor means.

2. A heat pump system as claimed in claim 1 in which said extracting means further includes pressurizing means for pressurizing the unevaporated refrigerant before supplying it to said further evaporating means.

3. A heat pump system as claimed in claim 1 in which said compressor means includes a motor having a motor casing, and said further evaporating means is constituted by the inside portion of said motor casing which is cooled by the evaporation of the unevaporated refrigerant.

4. A heat pump system as claimed in claim 1 in which said compressor means includes an oil cooler, and said further evaporating means is the heat exchange portion of said oil cooler.

5. A heat pump system as claimed in claim 1 in which said further evaporating means is sprayer means in said compressor means for spraying the unevaporated refrigerant into the refrigerant vapor from said compressor.

6. A heat pump system comprising:
a compressor means;
a condenser;
an evaporator;
refrigerant circulating passage means connected between said compressor means and said condenser and between said condenser and said evaporator and between said evaporator and said compressor means;
a refrigerant in said system;
means for circulating said refrigerant in said system to effect a heat pump cycle;
said refrigerant being a non-azeotropic refrigerant mixture consisting of primary component refrigerant and at least one subcomponent refrigerant, said subcomponent having a smaller molar fraction and a lower boiling temperature than those of said primary component;
said evaporator having at least the portion adjacent to the refrigerant outlet thereof a flooded type reactor construction, said reactor construction including means for heating the refrigerant in said portion by a fluid from a heat source, and means for supplying fluid from a heat source to said heating means; and
means connected to said evaporator for extracting unevaporated refrigerant in a liquid state from within said evaporator and feeding it to a point in said system the temperature of which is higher than the temperature of the heat source fluid for evaporating the thus extracted unevaporated refrigerant and then returning the thus evaporated refrigerant to said circulating passage means.

7. A heat pump system as claimed in claim 6 further comprising means in said extracting means for increasing the pressure of the evaporated refrigerant extracted from said evaporator before feeding it to said point in said system.

8. A heat pump system as claimed in claim 6 or 7 wherein said compressor means includes a motor and a casing for said motor, and said point is inside said electric motor casing, the refrigerant acting to cool said motor.

9. A heat pump system as claimed in claim 6 or 7 wherein said compressor means includes an oil cooler for cooling a lubricant used in said compressor means, and said point is said oil cooler.

10. A heat pump system as claimed in claim 6 or 7 wherein said compressor means includes a liquid spraying means for cooling vaporized refrigerant from said compressor, and said point is said liquid spraying means.

11. A heat pump system comprising:
a compressor means;
a condenser;
an evaporator;
a pressure reduction means;
refrigerant circulating passage means connecting said compressor means, said condenser, said evaporator and said pressure reduction means;
a refrigerant in said system;
means for circulating said refrigerant in said system to effect a heat pump cycle;
said refrigerant being a non-azeotropic refrigerant mixture;
means for extracting uncondensed refrigerant from the portion of said condenser adjacent the outlet thereof; and
further comprising an oil separating device connected between said evaporator and said compressor means for separating lubricant entrained in the refrigerant and collecting it, said compressor means having an oil reservoir, and said extracting means being connected between said condenser and said oil reservoir and including suction means connected to said oil separating device for sucking oil separated from the refrigerant out of said separating means and mixing it with the uncondensed refrigerant and delivering it to said oil reservoir.

12. A heat pump system as claimed in claim 11 in which said extracting means is connected to the lower portion of said evaporator, and includes an injecting means with a plurality of injecting opening therein.

13. A heat pump system as claimed in claim 12 further comprising an air extracting means connected between said condenser and said evaporator for extracting air from the uncondensed refrigerant.

14. A heat pump system as claimed in claim 12 in which said part of said passage means is the refrigerant outlet of said condenser.

15. A heat pump system comprising:
a compressor means;
a condenser;
an evaporator;
refrigerant circulating passage means connected between said compressor means and said condenser and between said condenser and said evaporator and between said evaporator and said compressor means;
a refrigerant in said system;
means for circulating said refrigerant in said system to effect a heat pump cycle;
said refrigerant being a non-azeotropic refrigerant mixture consisting of a primary component refrigerant and at least one subcomponent refrigerant, said subcomponent having a smaller molar fraction and a lower boiling temperature than those of said primary component;
said evaporator having at least the portion adjacent to the refrigerant outlet thereof a flooded type reactor construction;
means connected to said condenser for extracting uncondensed refrigerant vapor in the gaseous state within said condenser and returning it to a part of said passage means at a portion between said compressor means and condenser; and
pressurizing means in said extracting means for increasing the pressure of the uncondensed refrigerant extracted from said condenser before returning it to said passage means.

16. A heat pump system as claimed in claim 15, in which said extracting means is directed to the refrigerant outlet of said condenser.

17. A heat pump system comprising:
a compressor means;
a condenser;
an evaporator;
refrigerant circulating passage means connected between said compressor means and said condenser and between said condenser and said evaporator and between said evaporator and said compressor means;
a refrigerant in said system;
means for circulating said refrigerant in said system to effect a heat pump cycle;

said refrigerant being non-azeotropic refrigerant mixture consisting of a primary component refrigerant and at least one subcomponent refrigerant, said subcomponent having a smaller molar fraction and a lower boiling temperature than those of said primary component;

said evaporator having at least the portion adjacent to the refrigerant outlet thereof a flooded type reactor construction;

means connected to said condenser for extracting uncondensed refrigerant vapor in the gaseous state within said condenser; and an oil separating device connected between said evaporator and said compressor means for separating lubricant entrained in the refrigerant and collecting it, said compressor means having an oil reservoir, and said extracting means being connected between said condenser and said oil reservoir and including suction means connected to said oil separating device for sucking oil separated from the refrigerant out of said separating means and mixing it with the uncondensed refrigerant and delivering it to said oil reservoir.

18. A heat pump system comprising:

a compressor means;

a condenser;

an evaporator;

refrigerant circulating passage means connected between said compressor means and said condenser and between said condenser and said evaporator and between said evaporator and said compressor means;

a refrigerant in said system;

means for circulating said refrigerant in said system to effect a heat pump cycle;

said refrigerant being a non-azeotropic refrigerant mixture consisting of a primary component refrigerant and at least one subcomponent refrigerant, said subcomponent having a smaller molar fraction and lower boiling temperature than those of said primary component;

said evaporator having at least the portion adjacent to the refrigerant outlet thereof a flooded type reactor construction; and means connected to said condenser for extracting uncondensed refrigerant vapor in the gaseous state within said condenser, said extracting means being connected to said evaporator for delivering uncondensed refrigerant to said evaporator, and said extracting means being provided with an ejector therein connected to the lower portion of said evaporator for extracting unevaporated refrigerant therefrom and recirculating it to another part of said evaporator.

19. A heat pump system comprising:

a compressor means;

a condenser;

an evaporator;

refrigerant circulating passage means connected between said compressor means and said condenser and between said condenser and said evaporator and between said evaporator and said compressor means;

a refrigerant in said system;

means for circulating said refrigerant in said system to effect a heat pump cycle;

said refrigerant being a non-azeotropic refrigerant mixture consisting of a primary component refrigerant and at least one subcomponent refrigerant, said subcomponent having a smaller molar fraction and a lower boiling temperature than those of said primary component;

said evaporator having at least the portion adjacent to the refrigerant outlet thereof a flooded type reaction construction; and means connected to said condenser for extracting uncondensed refrigerant vapor in the gaseous state within said condenser, said extracting means being connected to the lower portion of said evaporator including an injecting means with a plurality of injecting openings for injection thereinto.

20. A heat pump system comprising:

a compressor means;

a condenser;

an evaporator;

refrigerant circulating passage means connected between said compressor means and said condenser and between said condenser and said evaporator and between said evaporator and said compressor means;

a refrigerant in said system;

means for circulating said refrigerant in said system to effect a heat pump cycle;

said refrigerant being a non-azeotropic refrigerant mixture consisting of a primary component refrigerant and at least one subcomponent refrigerant, said subcomponent having a smaller molar fraction and a lower boiling temperature than those of said primary component;

said evaporator having at least the portion adjacent to the refrigerant outlet thereof a flooded type reactor construction;

means connected to said condenser for extracting uncondensed refrigerant vapor in the gaseous state within said condenser; and p1 an air extracting means connected between said condenser and said evaporator for extracting air from the uncondensed refrigerant. rotors as in the present invention and FIG. 8 is a lateral section of an evaporator, FIG. 9 is an a1, p. 5 in the evaporator of the present invention a2, p. 15

* * * * *